US009133680B2

(12) United States Patent
Edwards

(10) Patent No.: US 9,133,680 B2
(45) Date of Patent: Sep. 15, 2015

(54) WELLBORE CONTROL DEVICE

(75) Inventor: Jeffrey Edwards, Aberdeenshire (GB)

(73) Assignee: ENOVATE SYSTEMS LIMITED, Dyce, Aberdeenshire (GB)

( * ) Notice: Subject to any disclaimer, the term of this patent is extended or adjusted under 35 U.S.C. 154(b) by 300 days.

(21) Appl. No.: 13/805,138

(22) PCT Filed: Jul. 4, 2011

(86) PCT No.: PCT/CA2011/000768

§ 371 (c)(1), (2), (4) Date: Jun. 27, 2013

(87) PCT Pub. No.: WO2012/000098

PCT Pub. Date: Jan. 5, 2012

(65) Prior Publication Data

US 2013/0270466 A1 Oct. 17, 2013

(30) Foreign Application Priority Data

Jul. 1, 2010 (GB) ..... 1011068.2

(51) Int. Cl.
*E21B 33/06* (2006.01)
*E21B 33/064* (2006.01)

(52) U.S. Cl.
CPC ..... *E21B 33/064* (2013.01); *E21B 33/063* (2013.01)

(58) Field of Classification Search
CPC ..... E21B 33/06; E21B 33/063; E21B 33/064
USPC ..... 251/1.1, 1.2, 1.3, 326, 79, 77; 166/363, 166/366; 137/81.2, 456, 494, 495, 613, 137/614.16
See application file for complete search history.

(56) References Cited

U.S. PATENT DOCUMENTS

| | | | | |
|---|---|---|---|---|
| 4,214,605 | A * | 7/1980 | Hardgrave | 137/495 |
| 4,215,749 | A | 8/1980 | Dare et al. | |
| 4,313,496 | A | 2/1982 | Childs et al. | |
| 4,488,703 | A | 12/1984 | Jones | |
| 4,508,313 | A * | 4/1985 | Jones | 251/1.3 |
| 4,519,575 | A | 5/1985 | Akkerman et al. | |
| 4,519,577 | A * | 5/1985 | Jones | 251/62 |
| 4,582,293 | A * | 4/1986 | Jones | 251/1.3 |
| 4,589,625 | A | 5/1986 | Jones | |
| 4,637,419 | A * | 1/1987 | Hughes | 137/236.1 |

(Continued)

FOREIGN PATENT DOCUMENTS

| | | |
|---|---|---|
| CN | 201386532 | 1/2010 |
| GB | 764315 | 12/1956 |
| WO | 9967500 | 12/1999 |

*Primary Examiner* — Marina Tietjen
*Assistant Examiner* — Umashankar Venkatesan
(74) *Attorney, Agent, or Firm* — Tarolli, Sundheim, Covell & Tummino LLP

(57) ABSTRACT

A wellbore control device for use in a blow out preventer is described. The control device comprising a housing defining a throughbore, a gate, the gate being movable between a throughbore open position and a throughbore closed position, a first stem attached to the gate and a second stem releasably engageable with the gate, the first and second stems being arranged such that a portion of each stem is exposed to an internal housing pressure and a portion of each stem is exposed to an external housing pressure. When the internal pressure is greater than the external pressure, the pressure differential results in a force being applied to the gate to move the gate to, or retain the gate in, the throughbore closed position.

26 Claims, 7 Drawing Sheets

(56) References Cited

U.S. PATENT DOCUMENTS 4,923,005 A 5/1990 Laky et al.
5,199,683 A * 4/1993 Le ..... 251/1.3
2001/0042848 A1 11/2001 Bartlett
2003/0029619 A1 2/2003 Sundararajan
2005/0242307 A1 11/2005 Springett et al.
2013/0087733 A1 * 4/2013 Rolland ..... 251/326

* cited by examiner

WELLBORE CONTROL DEVICE

FIELD OF THE INVENTION

The present invention relates to a wellbore control device and a method of using a wellbore control device. Particularly, but not exclusively, the present invention relates to a subsea wellbore control device and a method of using same.

BACKGROUND TO THE INVENTION

A blow out preventer is a safety device which is mounted to a subsea wellhead and is adapted to seal the wellhead in an emergency situation. Conventional blow out preventers (BOPs) generally have a number of wellbore control devices such as pairs of opposed rams which lie in a common plane, either side of the wellbore. In the event of an emergency, the rams are pushed together to seal the wellbore. The rams can be provided with cutting surfaces adapted to cut through wellbore equipment which may be located between the rams, such as a riser and/or a tool string. Once the rams have severed through the wellbore equipment, and are engaged with each other, the wellbore is sealed.

BOP rams can be controlled in one of two ways. The first is to close the rams using a pressure applied from surface, for example hydraulic pressure, to a pair of stems, each stem applying a push force to one of the rams. The drawback of such a system is that if the surface pressure fails, for whatever reason, the rams cannot be shut.

The second method is to use pressure applied from surface to hold the rams open and provide biasing devices such as springs or nitrogen accumulators, to shut the rams. When it is desired to shut the rams, the surface applied pressure is released and the biasing devices shut the rams. However, a failure of the hydraulic pressure system will result in closure of the rams unnecessarily. Additionally, biasing devices of sufficient strength to sever a riser and/or a tool string are extremely heavy, and should the biasing devices seize, the rams will not shut.

In both cases, in the open position, the ram stems extend out of the BOP housing into the surrounding water. If the hydrostatic or external pressure on the seabed is greater than the pressure in the BOP (wellbore pressure), the external pressure will act on the ends of the rams to close the rams. This pressure can be utilised to assist in sealing the wellbore. Once the rams are closed, the external pressure is balanced by one ram acting on the other. However, the most dangerous situation in a subsea well is when the internal pressure is higher than the external pressure. In this case, the internal pressure will hinder the closure of the rams, and indeed act to force closed rams apart.

Alternative BOP designs utilise a pressure balanced configuration. For example, one known type includes a pair of gates which, when it is desired to seal the wellbore, are pulled across the throughbore in opposite directions. In this arrangement, rather than lying in the same plane, the gates lie in parallel planes and slide across each other, shearing through wellbore equipment in the throughbore, to form a double barrier in the wellbore. There is a stem at each end of each gate, and the stems extend from the BOP housing into the surrounding water. The external pressure applied on the end of one stem is cancelled out by the equal external pressure applied to the end of the stem at the opposite end of the same gate. Therefore each gate is balanced at all times and the wellbore and environmental pressures have no effect on the movement of the ram.

However, this design of BOP still suffers from the same problem as the BOPs which incorporate opposed rams, in that closure of the throughbore is dependent on the presence of an external closure force in the form of an applied pressure from surface or an integral biasing device. Particularly, conventional BOPs do not have the ability to self close in a high internal pressure situation.

SUMMARY OF THE INVENTION

According to a first aspect of the present invention there is provided a wellbore control device for use in a blow out preventer comprising:

a housing, the housing defining a throughbore;

a gate, the gate being movable between a throughbore open position and a throughbore closed position;

a first stem attached to the gate; and a second stem releasably engageable with the gate, the first and second stems being arranged such that a portion of each stem is exposed to an internal housing pressure and a portion of each stem is exposed to an external housing pressure;

wherein when the internal pressure is greater than the external pressure, the pressure differential results in a force being applied to the gate to move the gate to, or retain the gate in, the throughbore closed position.

In an embodiment of the present invention, a wellbore control device is provided which is self-closing in the event of pressure within the wellbore control device exceeding pressure outside the wellbore control device. As the second stem is releasably engageable with the gate, but not attached to the gate, if the internal pressure exceeds the external pressure, the force generated by the pressure differential will push the gate and the second stem apart, and in doing so push the gate to the throughbore closed position against the lesser resistance force generated by the external pressure. Subsequently, should the internal pressure decrease to a level below the external pressure, the second stem moves under the influence of the external pressure back into engagement with the gate to balance the pressure across the gate. Once balanced, the gate will not move under the action of the external pressure.

This is of particular benefit in a subsea location where the external pressure is relatively high. If the internal pressure exceeds the external pressure in this environment, then a problem is probably developing in the well, and it is desirable to shut the well in this circumstance. The arrangement described will result only in the gate moving when the throughbore is open and as a result of a pressure differential created by the internal pressure exceeding the external pressure.

In the opposite situation, when the external pressure is greater than the internal pressure, the pressure differential creates a force which presses against the first and second stems. The stems, in turn, press against the gate from opposite directions, however, as the force applied by the external pressure on the stems is equal, the pressure across the gate is balanced, and the gate will not change position.

The gate may comprise an apertured portion and a solid portion, the apertured portion, in use, being aligned with the throughbore in the throughbore open position and the solid portion being aligned with the throughbore in the throughbore closed position.

The first stem may be attached to the gate apertured portion.

The wellbore control device may be provided with an activation mechanism. An activation mechanism may be provided to move the gate from one position to another, in normal use, as desired.

The activation mechanism may be adapted to apply a closing force and/or an opening force.

The closing and/or the opening force may be applied hydraulically.

The closing and/or the opening force may be applied electrically, mechanically or by any suitable means.

The closing and/or opening force may be applied from surface.

Alternatively or additionally, the closing and/or opening force may be applied by a remotely operated vehicle.

The closing and/or the opening force may be generated independently of each other.

The gate may be biased to the throughbore closed position by one or more biasing devices.

The biasing device(s) may be a spring or nitrogen accumulator or the like.

In one embodiment application of the closing force, in use, moves the first gate stem in a direction away from the wellbore control device throughbore.

In one embodiment, the gate may be held in the throughbore open position by a hydraulic force, for example, against the action of springs or nitrogen accumulators which bias the gate to the throughbore closed position. In this embodiment, removal of the hydraulic pressure causes the gate to spring shut.

In one embodiment, application of the closing force to the first stem results in the first stern applying a pull force to the gate. The pull force pulls the gate away from the second stem The second stem may be releasably engageable with the solid gate portion.

When engaged with the gate, the second stem may be adapted to transmit a force applied to the second stem to the gate.

The solid gate portion may include at least one element extending from a solid gate portion surface.

The second stem may be releasably engageable with the at least one element.

In one embodiment, once engaged with the gate, the gate and the second stem define a void therebetween. A void is provided to facilitate the force created by the internal pressure accessing the solid gate portion surface.

The throughbore may be at least partially defined by the housing casing.

The housing casing may define an internal chamber.

The internal chamber may be arranged, in use, to be at substantially the same pressure as the device throughbore.

In one embodiment, the internal chamber is, in use, at substantially the same pressure as the device throughbore in the throughbore open position.

In this and in alternative embodiments, the internal chamber may be sealed from the throughbore when the gate is in the throughbore closed position. Such an arrangement seals the higher internal pressure in the chamber. Should the throughbore pressure drop, this will not result in a change in the pressure differential which might result in a force which would open the gate.

At least one fluid flow path may exist between the wellbore control device throughbore and the housing internal chamber.

The wellbore control device may comprise at least one additional gate.

While the wellbore control device comprises at least one additional gate, the wellbore control device may further comprise an additional first stem and an additional second stem, an additional first stem and an additional second stem being associated with each additional gate. Each additional first and second stem is in a substantially identical relationship to an additional gate as the first and second stems of the first aspect of the invention.

In the preferred embodiment, there is one additional gate, the wellbore control device comprising an upper gate and a lower gate.

In this embodiment the upper gate and the lower gate are adapted to move in opposite directions.

In moving from the throughbore open position to the throughbore closed position the upper gate and the lower gate are adopted to form a sliding contact.

In an embodiment, the/each apertured gate portion includes a cutting surface.

The/each cutting surface may be attached to, or defined by, a surface defining the gate portion aperture.

Where there is an upper gate and a lower gate, the cutting surfaces cooperate, in use, to shear through any obstruction which may be in the wellbore control device throughbore as the gates move from the throughbore open position to the throughbore closed position.

According to a second aspect of the present invention there is provided a method of sealing throughbore, the method comprising the steps of:

providing a wellbore control device having a housing defining a throughbore, the wellbore control device having a gate in a throughbore open position;

exposing the gate to a pressure differential created by an internal housing pressure being greater than an external housing pressure, such that a force generated by the pressure differential separates the gate and a first stem attached to the gate from a second stem releasably engaged with the gate, the force moving the gate to the throughbore closed position.

According to a third aspect of the present invention there is provided a blow out preventer (BOP) for use with a subsea wellbore, the BOP comprising:

a housing, the housing defining a throughbore, the throughbore adapted to be aligned with a subsea wellbore;

at least one wellbore control device, each wellbore control device comprising:

a gate, the gate being movable between a throughbore open position and a throughbore closed position;

a first stem attached to the gate; and a second stem releasably engageable with the gate, the first and second stems being arranged such that a portion of each stem is exposed to an internal BOP pressure and a portion of the stem is exposed to an external BOP pressure;

wherein when the internal pressure is greater than the external pressure, the pressure differential results in a force being applied to the gate to move the gate to, or retain the gate in, the throughbore closed position.

According to a fourth aspect of the present invention there is provided a blow out preventer (BOP) for use with a subsea wellbore, the BOP comprising:

a housing, the housing defining a throughbore, the throughbore adapted to be aligned with a subsea wellbore;

at least one wellbore control device, each wellbore control device comprising:

an upper gate;

a lower gate, each gate being movable between a throughbore open position and a throughbore closed position;

a first stem attached to the upper gate;

a second stem releasably engageable with the upper gate;

a third stem attached to the lower gate; and a fourth stem releasably engageable with the lower gate, the first, second, third and fourth stems being arranged such that a portion of each stem is exposed to an internal BOP pressure and a portion of the stem is exposed to an external BOP pressure;

wherein when the internal pressure is greater than the external pressure, the pressure differential results in a force being applied to the gates to move each gate to, or retain each gate in, the throughbore closed position.

It will be understood that non-essential features recited in respect of one aspect may also be applicable to any other aspect and have not been repeated for brevity.

BRIEF DESCRIPTION OF THE DRAWINGS

An embodiment of the present invention will now be described with reference to the accompanying drawings in which.

DETAILED DESCRIPTION OF THE DRAWINGS

Figure 1:
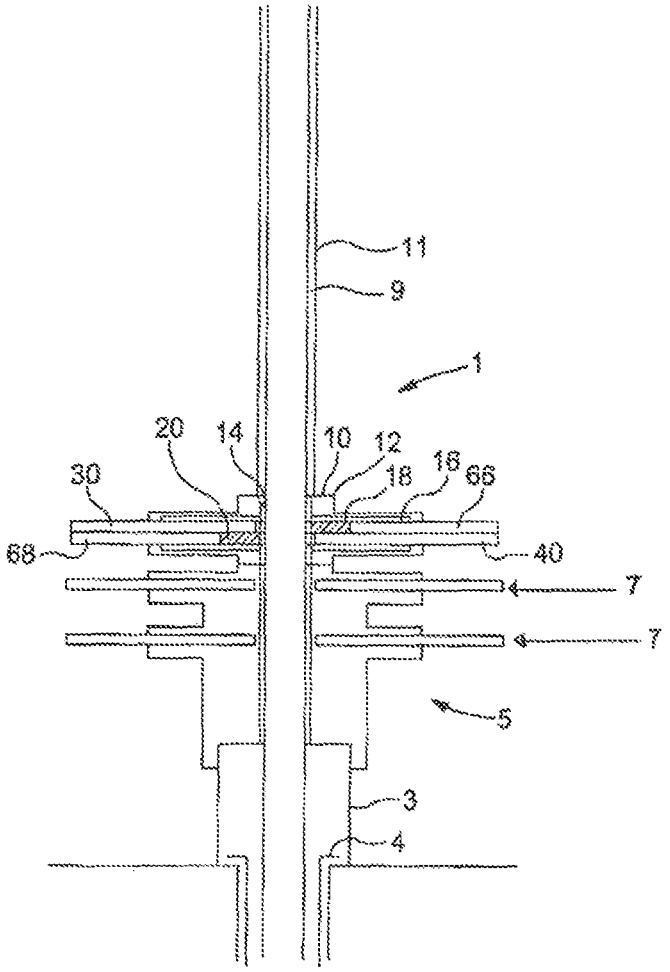
FIG. 1 is a schematic of a subsea wellhead including a wellbore control device according to an embodiment of the present invention.

Referring firstly to FIG. 1 a schematic of a subsea installation, generally indicated by reference numeral 1. The subsea installation 1 comprises a subsea well head 3, attached to a downhole casing 4, and a blow-out preventer 5. The blow-out preventer 5 includes two pairs of shear rams 7 and a wellbore control device 10 according to a first embodiment of the present invention. Passing through the subsea wellhead is a production tube 9 which runs to surface inside a riser 11.

Figure 2:
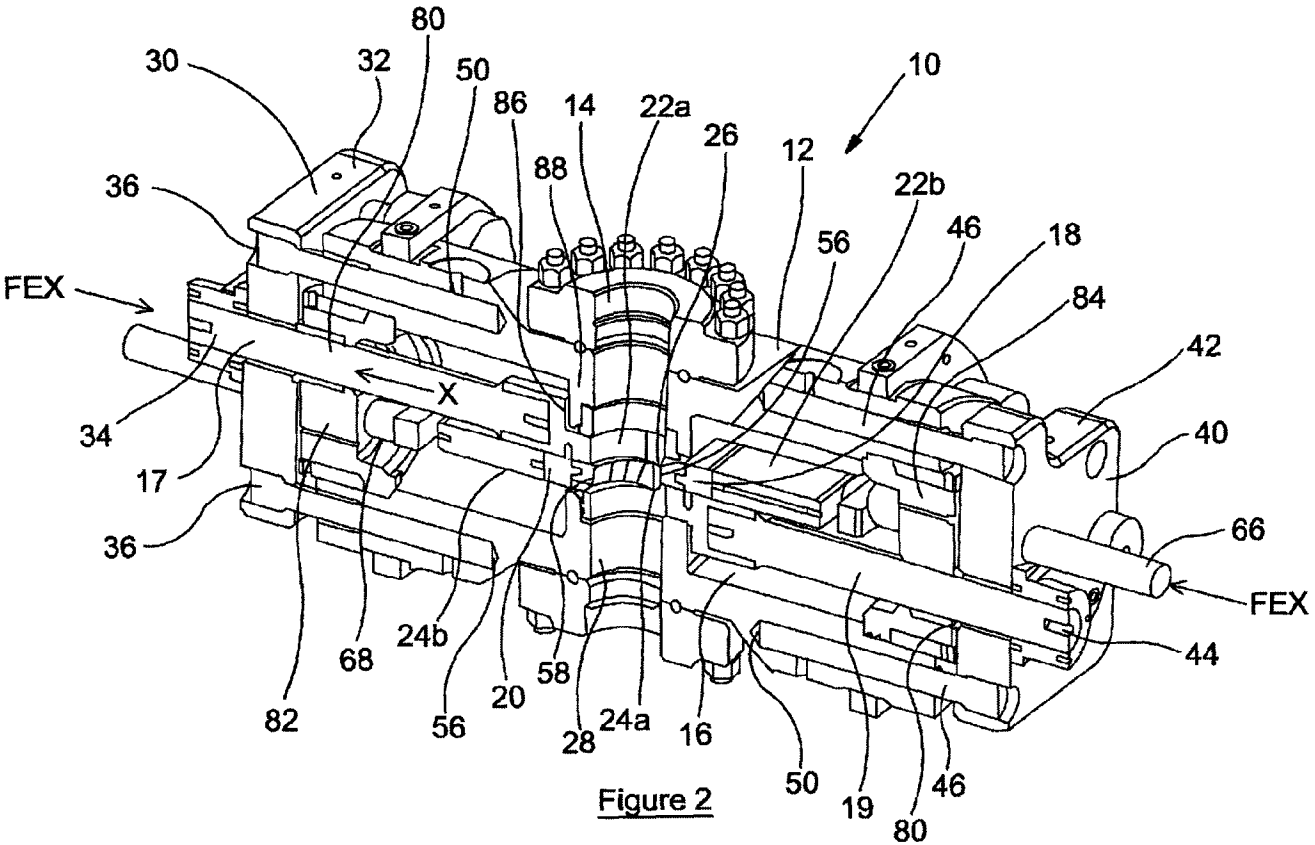
FIG. 2 is a perspective view of a section of the wellbore control device of FIG. 1 in a throughbore open configuration.
Figure 3:
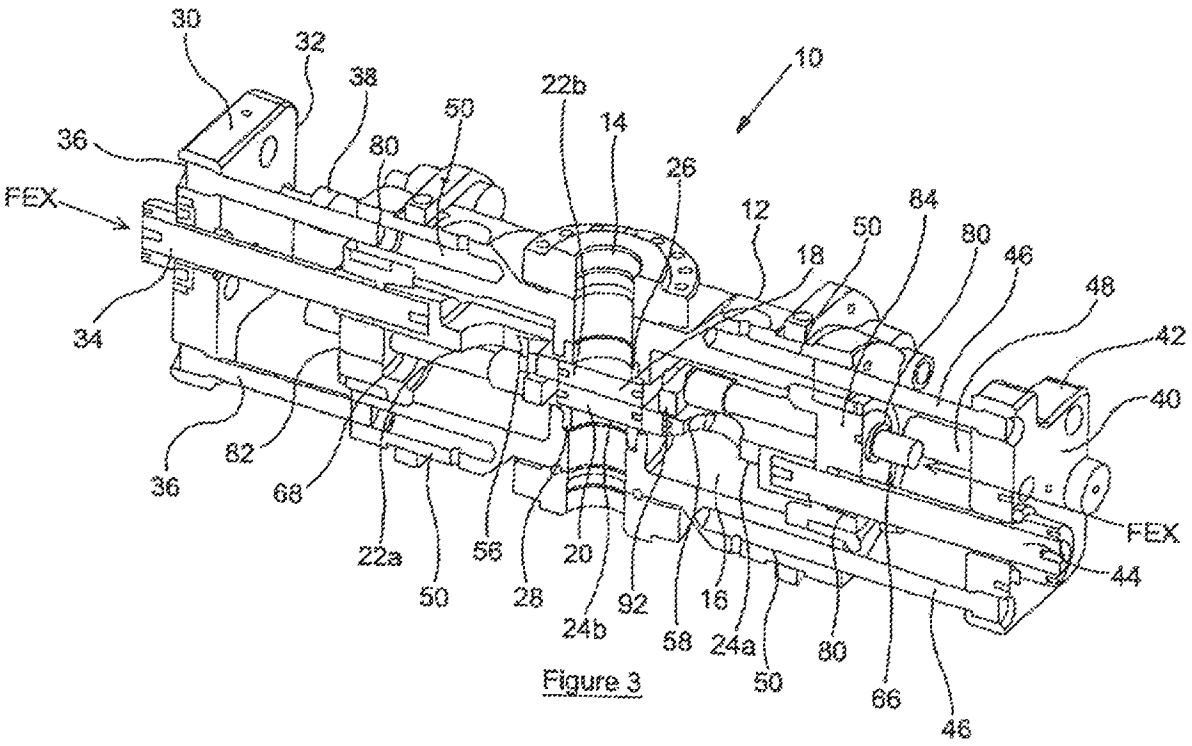
FIG. 3 is a perspective view of a section of the wellbore control device of FIG. 1 in the throughbore closed configuration.

The wellbore control device 10 will now be discussed in more detail with reference to FIG. 2 and FIG. 3, perspective views of a section of the wellbore control device, in a throughbore open configuration (FIG. 2) and a throughbore closed configuration (FIG. 3).

The wellbore control device 10 comprises a housing 12 defining a throughbore 14. In use, the throughbore 14 is aligned with a wellbore (not shown). The housing 12 also defines a chamber 16. Slidably mounted within the chamber 16 are an upper gate 18 and a lower gate 20. Each gate 18, 20 comprises an apertured portion 22*a*, 24*a* and a solid portion 22*b*, 24*b*. In the throughbore open position (FIG. 2) the gate apertured portions 22*a*, 24*a* are aligned, and the throughbore 14 is open. In the throughbore closed position (FIG. 3), the gate solid portions 22*b*,24*b* are aligned and the throughbore 14 is closed. In the throughbore closed position, the gate solid portions 22*b*,24*b* are engaged, and form a seal, with an upper seal seat 26 and a lower seal seat 28.

Both of the gate apertured portions 22*a*, 24*a* include a cutting surface 56, 58. As the gates 18, 20 are shut, the gates 18, 20 slide over each other in opposite directions and the cutting surfaces 56, 58 shear through any tubulars or tool strings which may be located in the wellbore control device 10.

Figure 4:
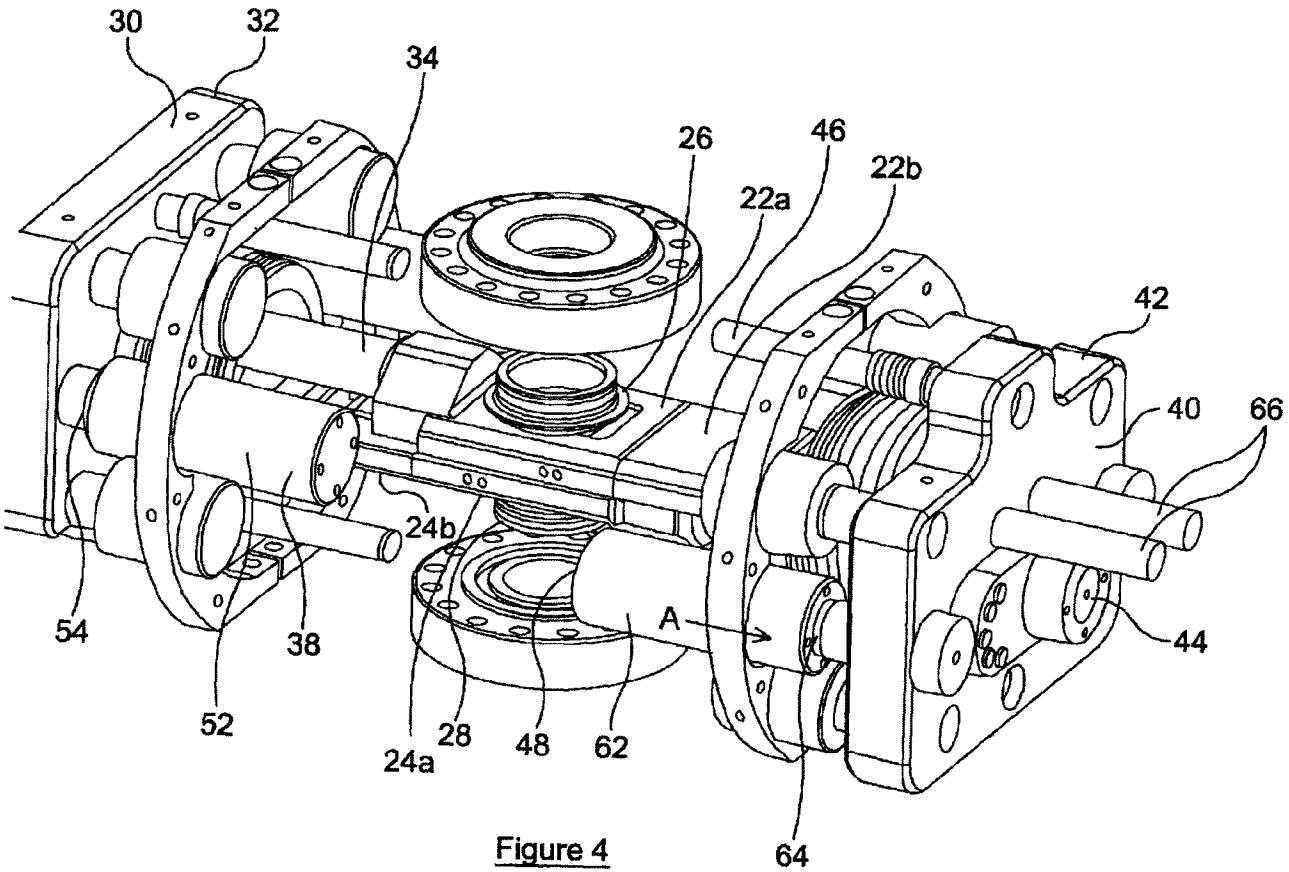
FIG. 4 is an enlarged perspective view of part of the wellbore control device of FIG. 1 in the throughbore open configuration.
Figure 5:
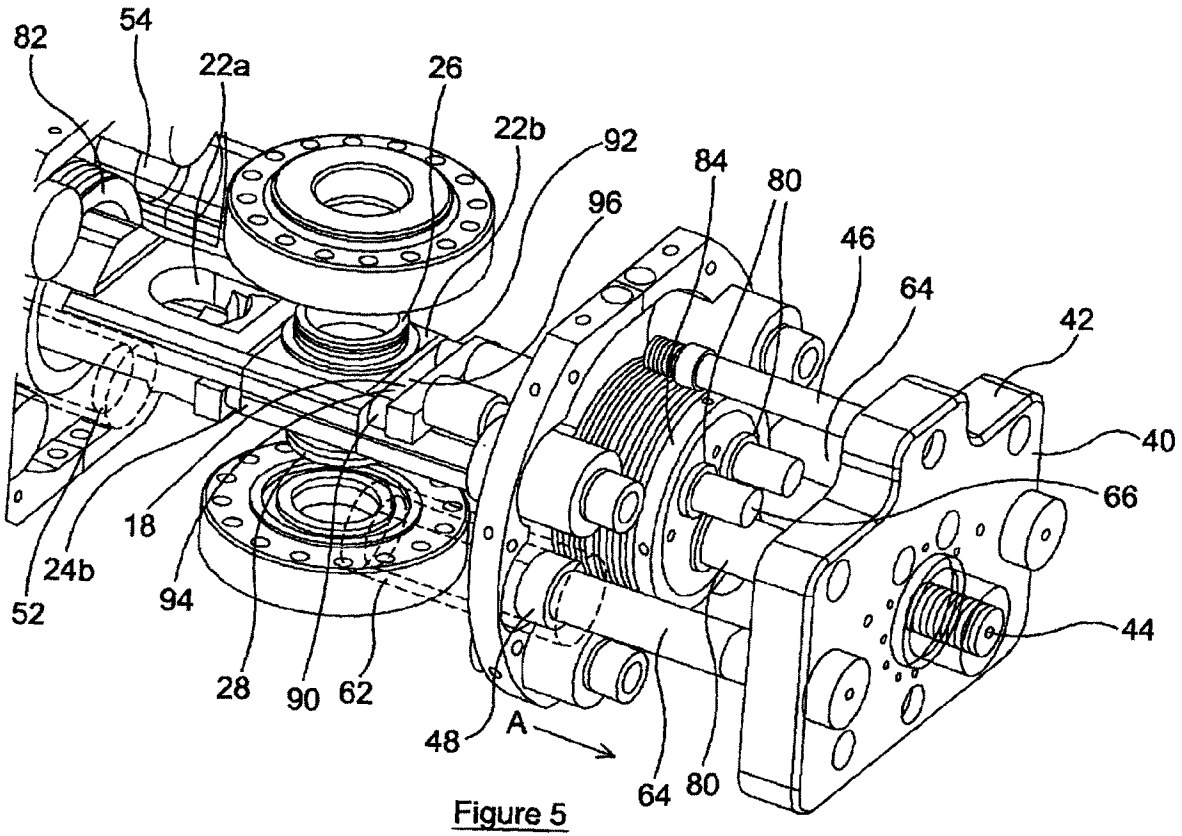
FIG. 5 is an enlarged perspective view of part of the wellbore control device of FIG. 1 in the throughbore closed position.

Referring to FIG. 3, the upper gate 18, and particularly the upper gate apertured portion 22*a*, is connected to a first upper gate stem 30. The lower gate 20, and particularly the lower gate apertured portion 24*a*, is connected to a first lower gate stem 40. The first upper gate stem 30 comprises a mounting plate 32, a gate arm 34, a pair of stem guides 36 and a pair of hydraulically powered drive piston assemblies 38. Only one drive piston assembly 38 is visible on FIG. 3, the piston assemblies 38 being more clearly visible on FIGS. 4 and 5, perspective views of part of the wellbore control device 10 of FIG. 1 in the open configuration (FIG. 4) and the closed configuration (FIG. 5).

Referring back to FIGS. 2 and 3, the stem guides 36 are adapted to slide within complementary slots 50 defined by the housing 12.

Similarly, the first lower gate stem 40 comprises a mounting plate 42, a gate arm 44, a pair of stem guides 46 and a pair of hydraulically powered drive pistons 48.

The drive piston assemblies 38, 48 will now be described with reference to FIGS. 4 and 5. Each drive piston assembly 38, 48 comprises a piston cylinder 52, 62 (shown in shadow on FIG. 5) and a piston arm 54, 64.

In an emergency situation, when it is required to shut the throughbore 14 and move the gates 18, 20 to the throughbore closed position, hydraulic fluid is introduced into the piston cylinders 52, 62 through inlet ports (not shown). The build-up of hydraulic pressure within the cylinders 52, 62 forces the piston arms 54, 64 away from the housing throughbore 14 (the lower gate stem piston arms 64 moving in the direction of arrow A and the upper gate stem piston arms 54 moving in the opposite direction). The movement of the piston arms 54, 64 moves the first upper and lower gate stems 30, 40 away from the housing throughbore 14, each first gate stem 30, 40 a playing a pull to each of the gates 18, 20, pulling the gates 18, 20 from the throughbore open position to the throughbore closed position. In doing so, any downhole tubulars or equipment located within the throughbore 14 are severed by the cutting surfaces 56, 58 and the throughbore 14 is sealed by the gate solid portions 22*b*, 24*b*.

Referring back to FIGS. 2 and 3, the wellbore control device 10 further comprises a second upper gate stem 66 and a second lower gate stem 68. The second upper gate stem 66 is adapted to releasably engage the upper gate solid portion 22*b* and the second lower gate stem 68 is adapted to releasably engage the lower gate solid portion 24*b*. The purpose of the upper gate stems 66, 68 is to balance the pressure across upper and lower gates 18, 20 respectively, as will be described in due course.

Figure 6:
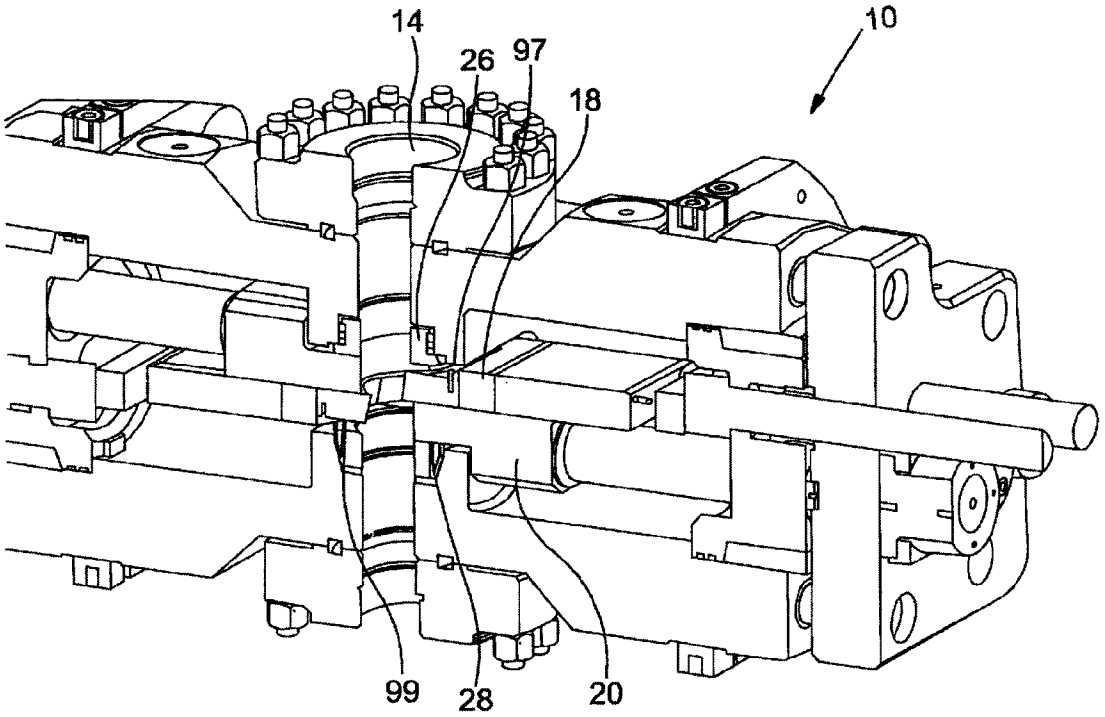
FIG. 6 is enlarged perspective view of a section of the wellbore control device of FIG. 1 in the throughbore open configuration.

Both the upper and lower gate sterns 30, 40, 66, 68 are arranged to slide through apertures 80 (best seen in FIG. 5) defined by a first housing end cap 82 and a second housing end cap 84. In this arrangement, each of the upper and lower gate stems 30, 40, 66, 68 are exposed to both the pressure within the housing internal chamber 16 and the pressure of the environment surrounding the wellbore control device 10. In the throughbore open position, the pressure within the housing internal chamber 16 is well pressure due to the provision of an upper leak path 97 (best seen in FIG. 6, an enlarged perspective view of part of the wellbore control device 10 of FIG. 1 in the throughbore open configuration) between the upper seal seat 26 and the upper gate 18, and a lower leak path 99 between the lower seal seat 28 and the lower gate 20.

It is extremely desirable that the wellbore control device 10 have the ability to close automatically in the event of a dangerous situation and the hydraulic closing system fails. Such a situation occurs when the pressure within the wellbore control device internal chamber 16 (the internal pressure) is higher than the hydrostatic pressure outside the wellbore control device 10 (the external pressure). However it is undesirable for the wellbore control device 10 to change state (from open to closed or from closed to open) when a relatively safe operating condition exists, that is the external pressure is higher than the internal pressure.

Examples of different pressure scenarios will now be described with reference to the upper gate 18, the first upper gate stem 30 and the second upper gate stem 66. It will be understood the same mode of operation will exist for the lower gate 20 and the first and second lower gate stems 40, 68.

Referring to FIG. 2, when the external pressure is greater than the internal pressure and the wellbore control device 10 is in the throughbore open position, shown in FIG. 2, the upper gate 18 will not move, as the external pressure is applying an equal but opposite force Fex to both the first upper gate stem 30 and the second upper gate stem 66 (which have the same cross-sectional area). As the forces Fex are equal and opposite, the wellbore control device 10 is pressure balanced.

Similarly when the wellbore control device 10 is in the throughbore closed position, shown in FIG. 3, and the external pressure is higher than the internal pressure, the external pressure force Fex applied to the first upper gate stem 30 is cancelled out by the force Fex applied to the second upper gate stem 66. Both of these situations are desirable as the wellbore control device 10 is not subject to a change in state because of a pressure differential existing in which the external pressure is greater than the internal pressure.

However, should the internal pressure increase to a situation in which it is dangerously high, and higher than the external pressure, then it is desirable for the wellbore control device gates 18, 20 to shut. Should the hydraulic closure system fail, the wellbore control device 10 of the present invention is adapted to utilise the pressure differential to shut the gates 18, 20 and seal the throughbore.

Referring to FIG. 5, the second upper gate stem 66 releasably engages the upper gate solid portion 22*b*, and particularly first and second upper gate solid portion stops 90, 92. Between the stops 90, 92 is a void 94, defined by the stops 90, 92, an upper gate end surface 96 and a second upper gate stem surface 98. When the internal pressure is higher than the external pressure, an internal pressure force Fin acts against the upper gate end surface 96 and the second upper gate stem surface 98, forcing them apart (FIG. 7, a perspective section view of the wellbore control device 10 of FIG. 1 in a throughbore closed position). As the gate 18 closes, the volume of the internal chamber 16 increases due to the displacement in opposite directions of the upper gate 18 and the second upper stem 66. This increase in volume leads to a decrease in pressure within the chamber and the release of energy which assists in shutting the gate 18.

Figure 7:
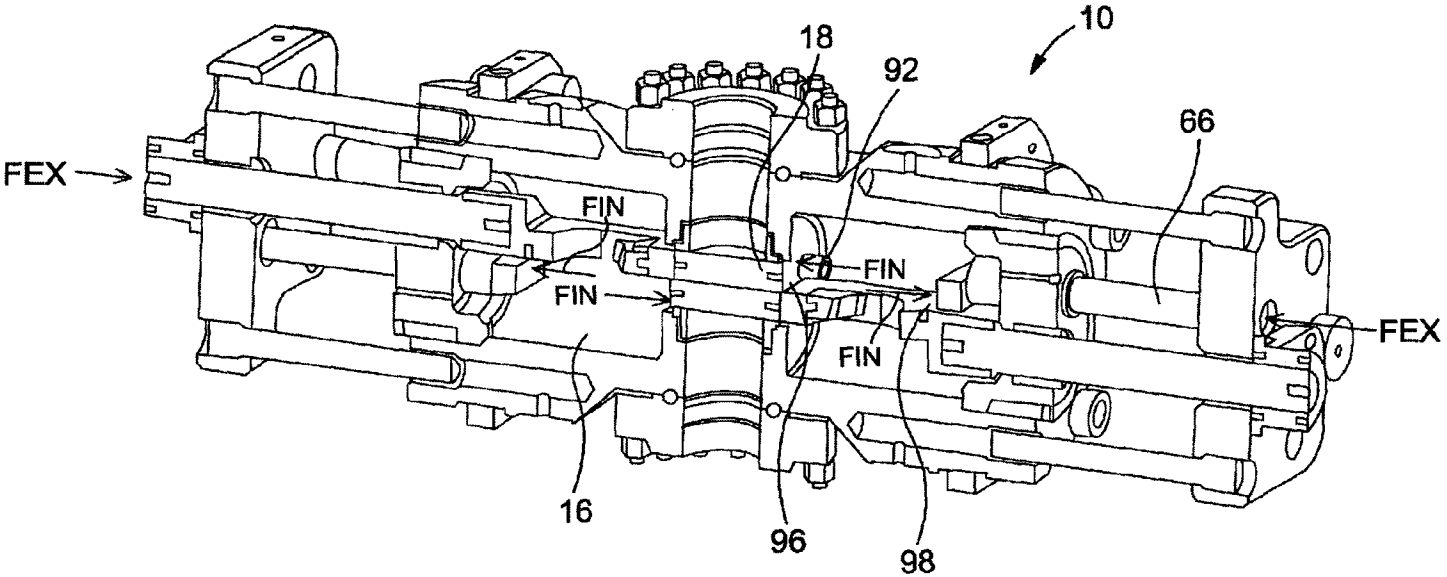
FIG. 7 a perspective view of a section of the wellbore control device of FIG. 1 in an alternative throughbore closed configuration.

The configuration shown in FIG. 7 exists as long as the internal pressure is higher than the external pressure. However, if the internal pressure drops it may not be desirable for the gates 18, 20 to re-open. When the internal pressure drops below the external pressure, the external force Fex acts on the first upper gate stem 30 and the second upper gate stem 66. The first upper gate stem 30 requires a greater force to move than the second upper gate stem 66 because it is heavier due to the mounting plate 32, the arm 44 stem guides 46 and the hydraulically powered pistons 48.

The second upper gate stem 66, however, can move relatively easily and under the influence of the external Force Fex moves from the position shown in FIG. 7 into engagement with the upper gate stops 90, 92 to the position shown in FIG. 3. In this position, the pressure on the upper gate 18 is once again balanced.

Various modifications and improvements may be made to the above described embodiment without departing from the scope of the invention. For example, although only one pair of gates shown, multiple pairs of gates could be used. In other embodiments, the seal seats 26, 28 May be adapted to float to reduce wear on the seal surfaces as the gates close. Once the gates are in the throughbore closed position, one or other of the seal seats would float into engagement with the gate with which it is associated.

The invention claimed is:

1. A wellbore control device for use in a blow out preventer comprising:

a housing, the housing defining a throughbore;

a gate, the gate being movable between a throughbore open position and a throughbore closed position;

a first stem attached to the gate; and a second stem releasably engageable with the gate, the first and second stems being arranged such that a portion of each stem is exposed to an internal housing pressure and a portion of each stem is exposed to an external housing pressure;

wherein when the internal pressure is greater than the external pressure, the pressure differential results in a force being applied to the gate to move the gate to, or retain the gate in, the throughbore closed position.

2. The wellbore control device of claim 1, wherein the gate comprises an apertured portion and a solid portion, the apertured portion, in use, being aligned with the throughbore in the throughbore open position and the solid portion being aligned with the throughbore in the throughbore closed position.

3. The wellbore control device of claim 2, wherein the first stem is attached to the gate apertured portion.

4. The wellbore control device of claim 2, wherein the wellbore control device is provided with an activation mechanism adapted to apply a closing force and/or an opening force.

5. The wellbore control device of claim 4, wherein the closing and/or the opening force is applied hydraulically.

6. The wellbore control device of claim 4, wherein the closing and/or opening force is applied from surface.

7. The wellbore control device of claim 4, wherein the closing end/or the opening force is generated independently of each other.

8. The wellbore control device of claim 4, wherein the gate is biased to the throughbore closed position by one or more biasing devices.

9. The wellbore control device of claim 8, wherein application of the closing force, in use, moves the first gate stem in a direction away from the wellbore control device throughbore.

10. The wellbore control device of claim 9, wherein the gate is held in the throughbore open position by a hydraulic force.

11. The wellbore control device of claim 9, wherein application of the closing force to the first stem results in the first aster applying a pull force to the gate.

12. The wellbore control device of claim 2, wherein the second stem is releasably engageable with the solid gate portion.

13. The wellbore control device of claim 12, wherein, when engaged with the gate, the second stem is adapted to transmit a force applied to the second stem to the gate.

14. The wellbore control device of claim 12, wherein the solid gate portion includes at least one element extending from a solid gate portion surface.

15. The wellbore control device of claim 14, wherein the second stem is releasably engageable with the at least one element.

16. The wellbore control device of claim 15, wherein one engaged with the gate, the gate and the second stem define a void therebetween.

17. The wellbore control device of claim 1, wherein the housing defines an internal chamber.

18. The wellbore control device of claim 17, wherein the internal chamber is arranged, in use, to be at substantially the same pressure as the device throughbore.

19. The we bore control device of claim 18, wherein the internal chamber is, in use, at substantially the same pressure as the device throughbore in the throughbore open position.

20. The wellbore control device of claim 19, wherein the internal chamber is sealed from the throughbore when the gate is in the throughbore closed position.

21. The wellbore control device of claim 17, wherein at least one fluid flow path exists between the wellbore control device throughbore and the housing internal chamber.

22. The wellbore control device of claim 1, wherein the wellbore control device comprises at least one additional gate.

23. The wellbore control device of claim 22, wherein where the wellbore control device comprises at least one additional gate, the wellbore control device further comprises an additional first stem and an additional second stem, an additional first stem and an additional second stem being associated with each additional gate.

24. The wellbore control device of claim 22, wherein there is one additional gate, the wellbore control device comprising an upper gate and a lower gate, wherein the upper gate and the lower gate are adapted to move in opposite directions.

25. A method of sealing throughbore, the method comprising the steps of:

providing a wellbore control device having a housing defining a throughbore, the wellbore control device having a gate in a throughbore open position, the gate being movable between the throughbore open position and a throughbore closed position, wherein the wellbore control device further comprises a first stem attached to the gate and a second stem releasably engageable with the gate, the first and second stems being arranged such that a portion of each stem is exposed to an internal housing pressure a portion of each stem is exposed to an external housing pressure;

exposing the gate to a pressure differential created by the internal housing pressure being greater than the external housing pressure, such that a force generated by the pressure differential separates the gate and the first stem from the second stem, the force moving the gate to the throughbore closed position.

26. A blow out preventer (BOP) for use with a subsea wellbore, the BOP comprising:

a housing, the housing defining a throughbore, the throughbore adapted to be aligned with a subsea wellbore;

at least one wellbore control device, each wellbore control device comprising:

a gate, the gate being movable between a throughbore open position and a throughbore closed position;

a first stem attached to the gate; and a second stems, releasably engageable with the gate, the first and second stems being arranged such that a portion of each stem is exposed to an internal BOP pressure and a portion of the stern is exposed to an external BOP pressure;

wherein when the internal pressure is greater than the external pressure, the pressure differential results in a force being applied to the gate to move the gate to, or retain the gate in, the throughbore closed position.

* * * * *

UNITED STATES PATENT AND TRADEMARK OFFICE

CERTIFICATE OF CORRECTION

PATENT NO. : 9,133,680 B2
APPLICATION NO. : 13/805138
DATED : September 15, 2015
INVENTOR(S) : Jeffrey Edwards It is certified that error appears in the above-identified patent and that said Letters Patent is hereby corrected as shown below:

Column 8, claim 11, Line 64 “aster” should read --stem--
Column 9, claim 19, Line 18 “we bore” should read --wellbore--
Column 10, claim 22, Line 29 “stems” should read --stem--
Column 10, claim 23, Line 32 “stern” should read --stem--

Signed and Sealed this
First Day of March, 2016

Michelle K. Lee

Michelle K. Lee
*Director of the United States Patent and Trademark Office*